US009051754B2

(12) United States Patent
Mallookis et al.

(10) Patent No.: US 9,051,754 B2
(45) Date of Patent: Jun. 9, 2015

(54) COLLAPSIBLE SHELTER ANCHOR

(71) Applicant: Go Papa, LLLP, Littleton, CO (US)

(72) Inventors: Steven E. Mallookis, Littleton, CO (US); Steven B. Mallookis, Littleton, CO (US)

(73) Assignee: Go Papa, LLLP, Littleton, CO (US)

( * ) Notice: Subject to any disclaimer, the term of this patent is extended or adjusted under 35 U.S.C. 154(b) by 0 days.

(21) Appl. No.: 13/963,547

(22) Filed: Aug. 9, 2013

(65) Prior Publication Data

US 2015/0040957 A1 Feb. 12, 2015

(51) Int. Cl.
*E04H 15/62* (2006.01)
*E04H 15/32* (2006.01)

(52) U.S. Cl.
CPC ..... *E04H 15/32* (2013.01); *E04H 15/62* (2013.01)

(58) Field of Classification Search
CPC ..... E04H 15/62
USPC ..... 135/16, 118, 120.1, 120.2, 120.3, 135/120.4; 248/500, 507, 508, 910; 383/88–91, 82, 83, 85, 121.1, 100, 104
See application file for complete search history.

(56) References Cited

U.S. PATENT DOCUMENTS

| | | | | |
|---|---|---|---|---|
| 584,726 | A * | 6/1897 | Lighthouse | 383/121 |
| 2,415,956 | A * | 2/1947 | Mamaux | 383/121.1 |
| 5,065,879 | A * | 11/1991 | King | 220/739 |
| 5,520,364 | A * | 5/1996 | Bloxson et al. | 248/500 |
| 5,524,990 | A * | 6/1996 | Buck | 383/34 |
| 5,931,583 | A * | 8/1999 | Collie | 383/89 |
| 6,149,305 | A * | 11/2000 | Fier | 383/91 |
| 6,186,662 | B1 * | 2/2001 | Jackson | 383/16 |
| 6,240,940 | B1 * | 6/2001 | Carter | 135/145 |
| 6,554,149 | B2 * | 4/2003 | Schneider et al. | 220/9.3 |
| 6,739,095 | B2 * | 5/2004 | Glynos | 52/4 |
| 6,964,277 | B2 * | 11/2005 | Naber | 135/16 |
| 7,353,833 | B1 * | 4/2008 | Palmer | 135/118 |
| 7,524,111 | B1 * | 4/2009 | Williams | 383/104 |
| 7,946,305 | B1 * | 5/2011 | Mailman | 135/16 |
| 8,656,937 | B1 * | 2/2014 | Minasi et al. | 135/118 |
| 8,783,274 | B1 * | 7/2014 | Supino | 135/16 |
| 2002/0026890 | A1 * | 3/2002 | Zook et al. | 114/294 |
| 2005/0061409 | A1 * | 3/2005 | Chung | 150/110 |
| 2012/0017960 | A1 * | 1/2012 | Doell | 135/120.1 |
| 2013/0051707 | A1 * | 2/2013 | Pisano et al. | 383/75 |

OTHER PUBLICATIONS

Explorer Dry Bag—Dry Bag Stuff—Seattle Sports Company <URL: http://www.seattlesportsco.com/productcart/pc/viewPrd.asp?idproduct=33&idcategory=11>, date accessed Aug. 9, 2013, 2 pgs.

* cited by examiner

*Primary Examiner* — Noah Chandler Hawk
(74) *Attorney, Agent, or Firm* — Brooks, Cameron & Huebsch, PLLC

(57) ABSTRACT

A collapsible shelter anchor can include a container including an opening reinforced about at least a portion of its periphery, a sidewall, and a bottom wall attached to the sidewall. The container can be filled with a material to an adjustable weight level. A coupling mechanism can connect the collapsible shelter anchor to a truss section of a collapsible shelter.

19 Claims, 5 Drawing Sheets

COLLAPSIBLE SHELTER ANCHOR

FIELD OF THE INVENTION

The present invention relates generally to an anchor, and more particularly to an anchor configured for releasable coupling to a collapsible shelter.

BACKGROUND OF THE INVENTION

Portable collapsible shelters, e.g., folding canopies, are in widespread use. These shelters are common at beaches, sporting events, farmers markets, weddings, graduations and other outdoor and indoor events. Collapsible shelters may provide portable, easily erectable, and durable shelters for varied purposes.

Portable collapsible shelters can include accordion-type collapsible truss assemblies between supporting legs of the shelter. Accordion-type collapsible truss assemblies can include a number of truss members interconnected at pivotal x-joints near truss member midpoints and at pivotal v-joints near truss member endpoints. The truss members may be connected at one endpoint to a portion of a shelter leg, e.g., at a slidable or fixed mounting bracket, and at another endpoint to another truss member at a pivotal v-joint. Thus, the accordion-type collapsible truss assembly can be expanded and collapsed to allow for ease of transport, setup, and takedown.

Truss assemblies for portable collapsible shelters were previously composed of thick walled steel tubing, or solid piping. To increase portability of collapsible shelters, some manufacturers have used lighter weight and lower strength materials, e.g., aluminum for example, in truss assemblies of collapsible shelters. To limit weight and cost, some manufacturers have also used thin walled truss members in portable collapsible assemblies. The increase in lightweight composition to portable collapsible shelters can make it more difficult to secure stabilization in a variety of environments and assembled uses.

DETAILED DESCRIPTION

Figure 1B:
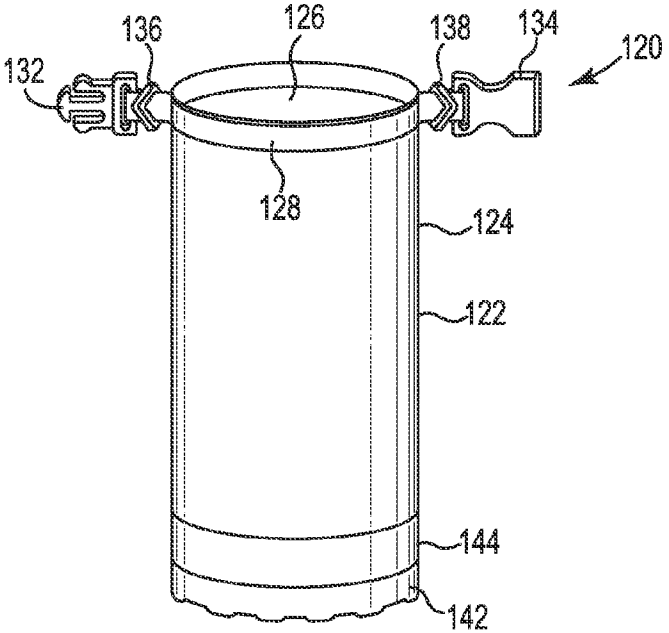
FIG. 1B is a perspective view of an anchor according to an assembled embodiment of the present invention.

The present disclosure includes a collapsible shelter anchor, a collapsible shelter anchoring system, and a collapsible shelter with a number of anchors attached. A number of embodiments include a collapsible shelter anchor comprising a container with an opening reinforced about at least a portion of its periphery, a sidewall, and a bottom wall attached to the sidewall. The container can be filled with a material to an adjustable weight level.

A number of embodiments of the present disclosure include a base plate reinforcing the bottom wall of the container and a sidewall extension portion with a first end coupled to the sidewall of the container and a second end coupled to the base plate. A number of embodiments include a coupling mechanism coupling the container to a collapsible truss section interconnecting a number of vertical support legs of a collapsible shelter.

The collapsible shelter anchor of the number of embodiments can anchor collapsible shelters to a surface. A collapsible shelter including a collapsible shelter anchor can resist forces (e.g. winds, weather conditions, jostling by people, jostling by machinery, jostling by other structures) to remain safely anchored in place.

Embodiments of the disclosed collapsible anchor system are different from stake down systems which are driven into the ground to stake tents to a ground surface. The collapsible shelter anchor of the number of embodiments allows a user to maintain a safely anchored collapsible shelter regardless of ground conditions. That is, a collapsible shelter anchor according to a number of embodiments of the present disclosure applies anchoring forces without requiring ground conditions conducive to insertion of a stake. For example, the collapsible shelter anchor system can be used indoors on a concrete floor, on a sidewalk, or on other surfaces that would prevent stake insertion. Additionally, the collapsible shelter anchor system can be used on surfaces that would prove too loose to provide sufficient frictional force for proper functioning of a stake, e.g., on a sandy beach.

Embodiments of the disclosed collapsible anchor system are different from tent ballasts which are attached low to collapsible shelter legs. That is, the collapsible shelter anchor embodiments can be coupled to a collapsible truss section of a collapsible shelter. Further, the collapsible shelter anchor of the number of embodiments is lightweight and collapsible, unlike bulky, heavy, rigid, and awkward and solid ground ballasts currently utilized. Embodiments of the collapsible shelter anchor are also highly portable and do not add unwieldy transport weight to the transport of a light weight collapsible shelter. Therefore, the collapsible shelter anchor embodiments can be easily portable with a collapsible shelter.

Further, unlike fixed weight ballasts, the collapsible shelter anchor of the number of embodiments provides a highly adjustable amount of anchoring force to a collapsible shelter. The collapsible shelter anchor allows a user to adjust the anchoring force applied to a collapsible shelter to at least three (3) different weight levels. A first adjustable weight level includes an in-the-field of use adjustable weight to the container by the addition and/or removal of an adjustable volume of material to the container. A second and third adjustable weight level relate to an adjustable exertion of the container upon a truss section of the collapsible shelter via a coupling, e.g., tethering and/or tensioning, mechanism. The second adjustable weight level may have the weight of the container supported while resting on a surface while the coupling mechanism adjustably tethers the container to a truss section of the collapsible shelter. A third adjustable weight level may have at least a portion of the first adjustable weight of the container, e.g., a range of the first adjustable weight, adjustably tension to and by supported by the truss section of the collapsible shelter. That is, an adjustable tensioning may be applied to some value greater than having a surface fully supporting a weight of the collapsible shelter anchor to a tensioning where a truss section of the collapsible shelter is fully supporting the range of the first adjustable weight from the truss section while the collapsible shelter anchor is pending fully above the surface. In this manner, the amount of anchoring force a user wishes to apply may be adjusted to meet prevailing environmental conditions (e.g., wind speed, wind direction, crowded environments with jostling, lack of level ground, etc.) and/or structural/material limitations associated with any given collapsible shelter.

In the following detailed description of the present disclosure, reference is made to the accompanying drawings that form a part hereof, and in which is shown by way of illustration how a number of embodiments of the disclosure may be practiced. These embodiments are described in sufficient detail to enable those of ordinary skill in the art to practice the embodiments of this disclosure, and it is to be understood that other embodiments may be utilized and that structural changes may be made without departing from the scope of the present disclosure. As used herein, "a number of" something can refer to one or more of such things. For example, a number of vertical support legs can refer to one or more vertical support legs.

The figures herein follow a numbering convention in which the first digit or digits correspond to the drawing figure number and the remaining digits identify an element or component in the drawing. Similar elements or components between different figures may be identified by the use of similar digits. For example, 142 may reference element "42" in FIG. 1A, and a similar element may be referenced as 342 in FIG. 3. As will be appreciated, elements shown in the various embodiments herein can be added, exchanged, and/or eliminated so as to provide a number of additional embodiments of the present disclosure. In addition, the proportion and the relative scale of the elements provided in the figures are intended to illustrate various embodiments of the present invention and are not to be used in a limiting sense.

While a collapsible shelter anchor 120 is discussed in the present disclosure, one of ordinary skill in the art will appreciate that embodiments of an anchor described herein may be used in applications with other anchoring systems and as anchors to structures other than collapsible shelters. For ease of description, embodiments in the disclosure are discussed in connection with collapsible shelters. However, embodiments are not limited to such use.

Figure 1A:
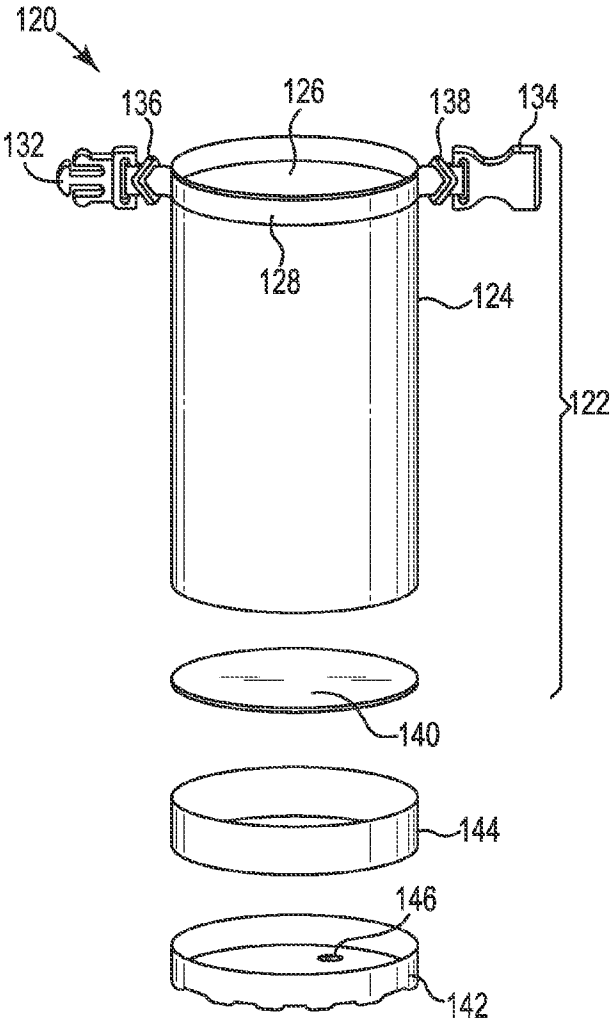
FIG. 1A is an exploded view of an anchor according to an embodiment of the present invention.

FIG. 1A illustrates an exploded view of an anchor 120 according to an embodiment of the present disclosure. FIG. 1B illustrates an assembled embodiment of a collapsible shelter anchor 120. As shown in the Figures, the collapsible shelter anchor includes a container 122. The container 122 can be configured in a number of shapes (e.g., square, spherical, tubular, triangular, etc.). In a number of embodiments, the container 122 can comprise a sidewall 124 and a bottom wall 140. The sidewall 124 and/or bottom wall can be made of a number of lightweight materials (e.g., Polyvinyl chloride, vinyl, urethane, etc.) and can be made of fiber reinforced variants of a number of lightweight materials. In a number of embodiments, the sidewall 124 and/or bottom wall 140 material of the container 122 is flexible (e.g., able to fold over itself) and collapsible. In some embodiments, the sidewall 124 and/or bottom wall 140 materials is a waterproof material. A sidewall 124 and/or bottom wall 140 comprising a waterproof material can be a material which substantially prevents water from passing through the material. The sidewall 124 and/or bottom wall 140 can be a puncture resistant material.

In some embodiments, the bottom wall 140 can be attached (e.g., adhesively joined, stitched, heat sealed, etc.) to the sidewall 124 of the container 122. In such embodiments the bottom wall 140 can be of the same material or different material from the sidewall 124. In such embodiments, the bottom wall 140 can be circumferentially larger than the circumference of the sidewall 124 of a tubular container and a portion of the bottom wall 140 can be attached to the inside and/or outside of the sidewall 124. For example, a bottom wall 140 with a circumference greater than the circumference of the sidewall 124 of a tubular container can be attached to the inside of the sidewall 124 by folding the portion of the bottom wall 140 exceeding the circumference of the sidewall 124 inside the circumference of the sidewall and attaching the portion to the inside of the sidewall 124.

Figure 1E:
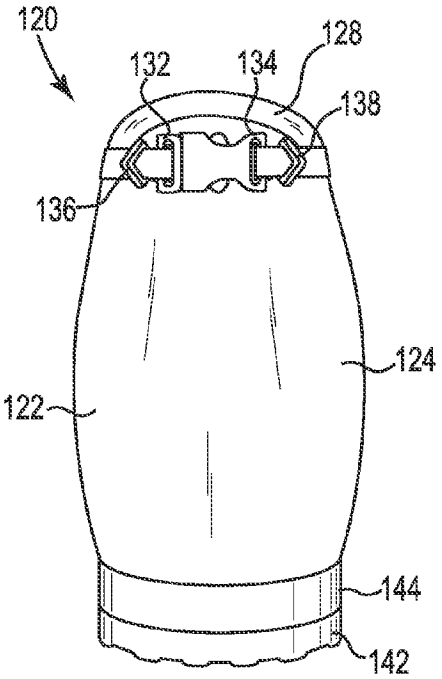
FIG. 1E is a perspective view of an embodiment of a collapsible shelter anchor from FIG. 1C in a biased closed configuration where a first releasably engageable body and a second releasably engageable body are releasably engaged.
Figure 1D:
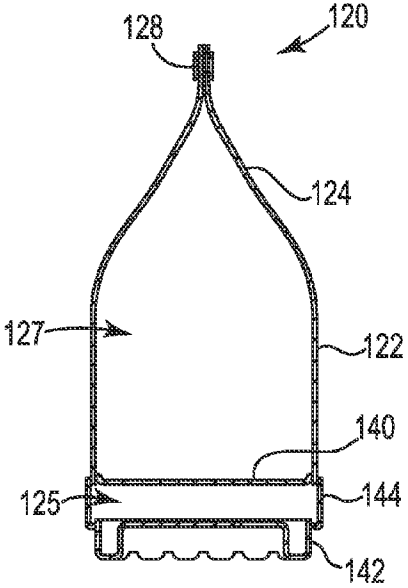
FIG. 1D is a cross-sectional view of an embodiment of a collapsible shelter anchor sectioned along cutline 1D-1D in FIG. 1C.

In a number of embodiments the bottom wall 140 can be a contiguous piece with the sidewall 124, e.g., as shown in the cutaway view of FIG. 1D. That is, the sidewall 124 can be formed such that it includes a bottom wall 140 without additional attachment. In a number of embodiments wherein the bottom wall 140 and the sidewall 124 are one contiguous piece, the bottom wall 140 of the container 122 can be defined by the portion of the contiguous piece proximal to a ground surface when suspended from a collapsible shelter.

The container 122 includes an opening 126 defined by an upper periphery of the sidewall 124, e.g., periphery to an opening of the container 122. The opening 126 can be of a shape and size to permit passage of various materials (e.g., water, earth, sand, rocks, etc.) into the container 122. In various embodiments, the anchor 120 can weigh less than half a pound (0.5 lbs.) and the container 122 can be filled to create a range to the first adjustable weight level of the container 122. For example, a selectable amount of sand can be placed in the container 122 to provide a first adjustable weight level in a range from half a pound (0.5 lbs.) to fifty pounds (50 lbs.). In another example, a selectable volume of liquid, e.g., water, can be added to the container 122 to fill the container 122 from zero liters (0.0 L) to eight liters (8 L). Embodiments, however, are not limited to these examples.

At least a portion of the periphery is reinforced about the opening 126 with a reinforcing material 128. The reinforcing material 128 can, for example, be a nylon webbing strap attached (e.g. stitched and/or adhesively bonded) about the periphery of the opening 126. In some embodiments, the reinforcing material 128 is attached around the entire periphery of the opening 126 of the container 122 and provides additional flange material on opposing sides of the opening 126. In some embodiments reinforcing material 128 is continuous around the periphery of the opening 126 and with the additional flange material and is of the same material.

The reinforcing material 128 can be attached about the periphery of the opening 126 such that it biases the opening 126 to a closed configuration. That is, the reinforcing material 128 is attached to the periphery of the opening 126 such that the opening 126 tends to close upon itself. For example, in at least one embodiment such as shown in FIG. 1D, the reinforcing material 128 can be attached such that the opening 126 tends to be substantially folded into two halves which lay against one another without the application of force external to the container 122, thus biasing the opening 126 to a closed configuration. FIG. 1A depicts the opening 126 in an open configuration which can be achieved by application of force external to the container 122.

The container 122 can include a releasable engagement mechanism coupled to the periphery of the opening 126 of the container 122 for bringing two opposing sides of the periphery of the opening 126 together. The releasable engagement mechanism can be a buckle mechanism that can include a first releasably engageable body 132 and a second releasably engageable body 134 coupled to the container 122. For example, the first releasably engageable body 132 and the second releasably engageable body 134 can be attached to the container 122 opposite one another about the opening 126. The first releasably engageable body 132 and the second releasably engageable body 134 can, in a number of embodiments, be attached about the periphery of the opening 126 of the container 122 via the reinforcing material 128. For example, a portion of the reinforcing material 128 comprising a nylon webbing strap attached (e.g. stitched and/or adhesively bonded) about the periphery of the opening 126 can be looped through an opening of the first and/or second releasably engageable body 132, 134. By attaching the first releasably engageable body 132 and the second releasably engageable body 134 via the reinforcing material 128, the first releasably engageable body 132 and second releasably engageable body 134 can act together with the reinforcing material 128, when releasably engaged, to form a force distributing component which distributes force associated with, tethering, lifting or suspending the container 122. Such a force can thus be distributed about the periphery of the opening 126 rather than at a single point of tethering, lifting or suspension with a truss section of a collapsible shelter. Further, when engaged, the first releasably engageable body 132 and the second releasably engageable body 134 can preserve a closing bias of the reinforcing material 128 under loads associated with, tethering, lifting or suspending the container 122 when it contains material.

While the first releasably engageable body 132 and the second releasably engageable body 134 of the releasable engagement mechanism are illustrated and described as part of a buckle mechanism, embodiments are not so limited. That is, a first releasably engageable body 132 and a second releasably engageable body 134 to a releasable engagement mechanism can include hook and loop fasteners, snaps, and/or other attachment means.

In at least one embodiment, the container 122 includes a first eyelet 136, e.g., a first, rigid plastic D-ring, and a second eyelet 138, e.g., a second, rigid plastic D-ring, attached to the container 122. The first eyelet 136 and a second eyelet 138 can be coupled to the periphery of the opening 126 of the container 122. The first eyelet 136 and the second eyelet 138 can be attached opposite one another about the periphery of the opening 126 of the container 122. The first eyelet 136 and the second eyelet 138 can be attached about the periphery of the opening 126 of the container 122 via a portion of the reinforcing material 128 attached about the periphery of the opening 126. For example, a reinforcing material 128 comprising a nylon webbing strap attached (e.g. stitched and/or adhesively bonded) about the periphery of the opening 126 can be looped through an opening of the first eyelet 136 and the second eyelet 138.

In at least one embodiment, the first eyelet 136 is attached about the periphery of the opening 126 proximate the first releasably engageable body 132 and the second eyelet 138 is attached about the periphery of the opening 126 proximate the second releasably engageable body 134. The first eyelet 136 and the second eyelet 138 can be attached to the periphery of the opening 126 proximate the first releasably engageable body 132 and the second releasably engageable body 134, respectively, by a flange of the reinforcing material 128 through a same loop of the flange on each opposing side of the opening 126.

In a number of embodiments, the first eyelet 136 and the second eyelet 138 can be configured to receive (e.g., receive a mated hook member through the first eyelet and the second eyelet 136,138) a coupling mechanism (e.g., a coupling mechanism configured to couple the container 122 to a collapsible shelter). The coupling mechanism (illustrated in FIG. 2) can include an adjustable tensioning strap configured at a first end to attach to the first eyelet 136 proximate the first releasably engageable body 132 and the second eyelet 138 proximate the second releasably engageable body 134 of the container 122. Such an adjustable tensioning strap can be configured at a second end to attach to a collapsible truss section of a collapsible shelter, as described in FIGS. 2 and 3. Alternatively, the container 122 can include one (1), or more than two (2) eyelets configured at various locations about the periphery of the opening 126. The adjustable tensioning strap can be configured to tether the container 122 to the collapsible truss section a first weight level, e.g., a weight level adjustable by a volume and material type placed in the container 122. The adjustable tensioning strap can also control the second and third weight levels in the manner described above.

In a number of embodiments of the present disclosure, the collapsible shelter anchor 120 can further comprise a base plate 142. The baseplate 142 can provide reinforcing to the bottom wall 140 of the container 122. The baseplate 142 can be a different material than the container 122 (e.g., a harder, less flexible material). The baseplate 142 can be coated in a durable fabric (e.g., nylon, rayon, canvas, Cordura). In a number of embodiments, the baseplate 142 can include raised ridges arranged circumferentially about the baseplate 142. The baseplate 142 can be designed to rest on these ridges (e.g., forming a bottom surface of the baseplate 142) and therefore the ridges can include additional reinforcement and/or thickness than the rest of the baseplate 142. The baseplate 142 resting on its ridges can provide added upright stability to the anchor 120. Additionally, the ridges to the baseplate 142 can provide added frictional resistance to the movement of the collapsible shelter anchor 120 when resting on an uneven surface. For example, the baseplate 142 can provide a rigid, substantially flat footprint for the anchor to rest upon, regardless of surface type, and encourage the anchor to remain stationary and upright when filled with a load.

The collapsible shelter anchor 120 can include, in a number of embodiments, a sidewall extension portion 144. A first end of the sidewall extension portion 144 can be coupled to the sidewall 124 of the container 122. For example, a first end of the sidewall extension portion 144 can be adhesively joined, stitched, and/or heat sealed to the sidewall 124 of the container 122 in an area of the sidewall 124 proximal the bottom wall 140. A second end of the sidewall extension portion 144 can be coupled to the baseplate 142. For example, a portion of the second end of the sidewall extension portion 144 can be folded under the baseplate 142 such that a portion of its outer perimeter rests against a bottom surface of the baseplate 142 and is adhesively joined, stitched, and/or heat sealed to the baseplate 142. Furthermore, the second end of the sidewall extension portion 144 can be coupled to the baseplate 142 on a portion of the outer perimeter of the baseplate 142 distal the bottom surface of the baseplate 142.

In a number of embodiments including a sidewall extension portion 144, a cavity 125, as shown in FIG. 1D, can exist within an area bounded by the circumference of the sidewall extension portion 144 between the container 122 and the baseplate 142. Such a cavity 125 can be prone to collecting moisture and organic material which can contribute to degradation of the sidewall extension portion 144, the base plate 142, and the container 122. Further, collecting material in this cavity 125 can result in accumulation of weight to the collapsible shelter anchor 120 and potential development of odors. However, the baseplate 142 includes a vent 146 configured to provide ventilation to the cavity between the baseplate 142 and the container 122. In a number of embodiments, the vent 146 can be configured to act as a drain to drain the cavity of water or other materials. The vent 146 can also be configured to permit passage of air into and out of the cavity. In doing so, the vent 146 can be configured to permit expulsion of water, air, and materials during collapse of the collapsible shelter anchor 120 (e.g., for storage or transportation).

FIG. 1B illustrates a perspective, assembled view of the collapsible shelter anchor 120 according to an embodiment of the disclosure. The collapsible shelter anchor 120 depicted in FIG. 1B includes a container 122. The container of FIG. 1B includes a sidewall 124. The container 122 depicted in FIG. 1B comprises an opening 126 reinforced about at least a portion of its periphery. The opening 126 is depicted as reinforced about the entire periphery with the reinforcing material 128. The portion of reinforcing material 128 is depicted attached about the periphery of the opening 126. FIG. 1B depicts the opening 126 in an open configuration which can be achieved with the application of force external to the container 122. For example, FIG. 1B can be a depiction of the opening 126 wherein an external force is applied to the sidewall 124 proximal to opening 126. In such an example, the external force serves to relieve a closing bias of the reinforcing material 128 that serves to pinch closed the opening 126.

In FIG. 1B, the container 122 includes a releasable engagement mechanism coupled to the periphery of the opening 126 of the container 122. The releasable engagement mechanism, in FIG. 1B, includes a buckle mechanism including a first releasably engageable body 132 and a second releasably engageable body 134 coupled to the container 122. FIG. 1B depicts the first releasably engageable body 132 and the second releasably engageable body 134 attached about the periphery of the opening 126 of the container 122 via a looped portion of reinforcing material 128 attached about the periphery of the opening 126. Additionally, FIG. 1B shows a first eyelet 136 and a second eyelet 138 coupled to the periphery opening 126 of the container 122. The first eyelet 136 and the second eyelet 138 are attached opposite one another about the periphery of the opening 126 of the container 122 via a looped portion of reinforcing material 128 attached about the periphery of the opening 126. FIG. 1B depicts the first eyelet 136 located proximal the first releasably engageable body 132 and the second eyelet 138 located proximal the second releasably engageable body 134. That is, the first eyelet 136 and the first releasably engageable body 132 are attached via a shared looped portion of reinforcing material 128 opposite the opposing shared loop portion of reinforcing material 128 attaching the second eyelet 138 and the second releasably engageable body 134. In at least one embodiment, the reinforcing material 128 includes a continuous loop of reinforcing material 128.

The container 122 in FIG. 1B includes a bottom wall (not visible in assembled view) attached to the sidewall 124. FIG. 1B additionally shows a ridged base plate 142. In the assembled view of FIG. 1B, a sidewall extension portion 144 is shown coupled, at a first end, to the sidewall 124 of the container 122 and coupled, at a second end, to the baseplate 142. The cavity within an area bounded by the circumference of the sidewall extension portion 144 between the container 122 and baseplate 142, and the vent 146 can be present but not visible in FIG. 1B.

Figure 1C:
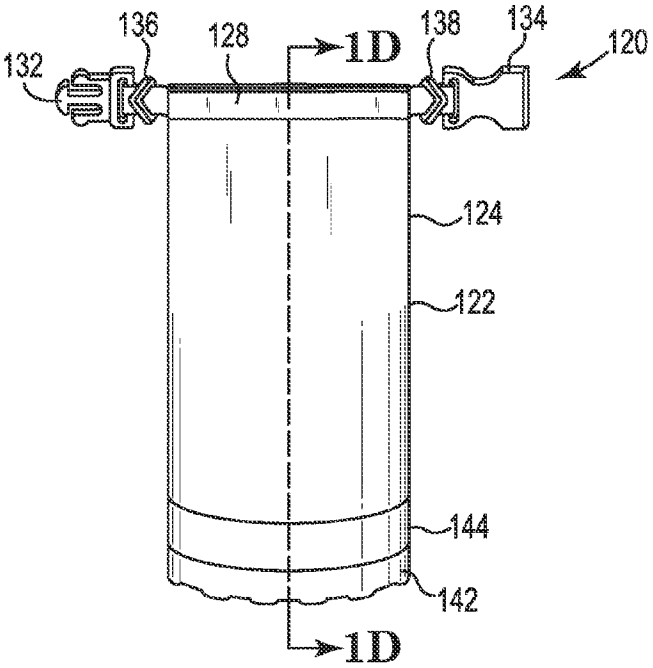
FIG. 1C is a perspective view of the collapsible shelter anchor of FIG. 1B in a biased closed configuration.

FIG. 1C is a perspective view of the collapsible shelter anchor 120 of FIG. 1B in a biased closed configuration wherein the opening (not visible) is biased closed via the portion of reinforcing material 128. The biased closed configuration illustrated in FIG. 1C can function to retain (e.g., prevent spillage of, prevent evaporation of, prevent others from accessing, etc.) the contents (e.g., material) of the container 122. Moreover, the biased closed configuration can prevent the inadvertent addition (e.g., addition via rain, addition via snow, addition via wind, etc.) of material to the container 122, which can introduce unnecessary or unintended force upon a collapsible shelter to which it is connected.

FIG. 1D is a cross-sectional view of the shelter anchor 120 of FIG. 1C sectioned along cutline 1D of FIG. 1C. FIG. 1D illustrates the shelter anchor 120 in a biased closed configuration. The portion of reinforcing material 128 can introduce the closing bias to the shelter anchor 120. The bottom wall 140 is illustrated as continuous material with the sidewall 124 of a tubular container. In the embodiment of FIG. 1D, the shelter anchor 120 includes a central cavity 127 comprising a volume of space within an area bounded by the sidewall 124 and the bottom wall 140. The container 122 is configured to be filled (e.g., via its opening) with an adjustable volume of material, e.g., earth, sand, water, etc., within its central cavity 127. The first end of the sidewall extension portion 144 is coupled to the sidewall 124 of the container 122 and a second end of the sidewall extension portion 144 is coupled to the base plate 142. A cavity 125 exists within an area bounded by the circumference of the sidewall extension portion 144 between the container 122 and the baseplate 142. The baseplate 142 can include a vent (e.g., vent 146 of FIG. 1A) configured to provide ventilation to the cavity 125 between the baseplate 142 and the container 122. In some embodiments a sidewall extension portion 144 is a separate component and in other embodiments the sidewall extension portion may be integral with the sidewall 122 and/or baseplate 142 of the container 122.

In a number of embodiments, the collapsible shelter anchor 120 can include the features shown in FIGS. 1A-1D, excepting the baseplate 142 and the integral or separate sidewall extension portion 144. That is, a number of embodiments can include a container 122 having a sidewall and an opening reinforced about at least a portion of its periphery with a reinforcing material 128 introducing a closing bias. A releasable engagement mechanism and first and second eyelets can be included in such embodiments and attached to a periphery of an opening to the container 122 as described above.

In still other embodiments, the baseplate can be integral to the container, e.g., integrally molded to a bottom wall 140 of the container 122. In such embodiments, the bottom wall 140 can include additional reinforcement, e.g., ridges, formed directly thereon. In other embodiments, a baseplate may be entirely absent from a bottom wall 140 of the collapsible shelter anchor 120. Embodiments without a separate and distinct baseplate can be well suited for light duty applications and/or full suspension upon a collapsible shelter.

FIG. 1E is a perspective view of the collapsible shelter anchor 120 of FIG. 1C in a biased closed configuration where the first releasably engageable body 132 and the second releasably engageable body 134, attached via a portion of reinforcing material 128 to the collapsible shelter anchor 120, are releasably engaged to bring two opposing sides of the periphery of container 122 together and to further retain closed the opening 126 to the container 122. The releasably engaged position of the first releasably engageable body 132 and the second releasably engageable body 134 further serves to bring together the first eyelet 136 and the second eyelet for ease of coupling a first end, e.g., hook, of a coupling mechanism (illustrated in FIGS. 2 and 3) to the first eyelet 136 and the second eyelet 138. In this biased closed configuration with the first engageable body 132 and the second releasably engageable body 134 releasably engaged, forces associated with lifting or suspending the container 122 can be distributed about the periphery of the collapsible shelter anchor 120 rather than at a single point of lifting or suspension. Further, when engaged, the first releasably engageable body 132 and the second releasably engageable body 134 can preserve the closing bias of the portion of reinforcing material 128 under various volumes and material types placed in the container 122. The reinforcing material 128 and the first releasably engageable body 132 and the second releasably engageable body 134, when releasably engaged to bring two opposing sides of the periphery of container 122 together and attach to a coupling mechanism can further assist with the collapsible shelter anchor 120 resting flat on a surface and standing upright relative to the surface.

As the reader will appreciate from the embodiment view of FIG. 1C, the reinforcing material 128 attached about the periphery of the opening 126 of the container 122 with its biased closed position provides a crease line such that the periphery of the container 122 may be folded downward along the reinforcing material 128 in an overlapping manner while an adjustable volume of material is in the container 122. The downward folds along the reinforcing material 128 can be achieved before releasably engaging the first releasably engageable body 132 and the second releasably engageable body 134. In this manner, embodiments can further retain, e.g., prevent spillage, etc., the contents of the container 122 and the added closure can further prevent the inadvertent addition of material, e.g., addition via rain, snow, wind, etc., to the container 122.

FIG. 2 is a perspective view of a collapsible shelter anchor system 250 releasably coupled to a collapsible frame assembly 252. In the embodiment illustrated in FIG. 2, a canopy 254, typically of canvas or polyester composition and of a generally polygonal configuration with four corners is shown attached to an erected collapsible frame assembly 252. The collapsible frame assembly 252 can include four vertical support legs (e.g., vertical support leg 256) at spaced peripheral intervals. In a number of embodiments, the collapsible frame assembly 252 can have more or fewer that four vertical support legs at spaced peripheral intervals. Each vertical support leg 256 can have an upper and lower telescoping members 258 and 260 which can be connected with an adjustable locking member 262 (for example the U-Push™ by Undercover™) to regulate a length of extension. In a number of embodiments, the vertical support legs can be of any suitably shaped cross-section and can be comprised of any number of telescoping members. In some embodiments, the vertical support legs may also incorporate other mechanisms of extension and collapse (e.g. folding, detachable assembly, etc.). The frame assembly 252 has outer peripheral truss sections (e.g., 264-1 and 264-2) made up of two pair of scissors-like pivotal truss arm members 268-1 and 268-2, each pair interconnected at pivotal x-joints 270. The truss sections are connected in end-to-end relation to one another by upper and lower intermediate mounting members 272 and 274 between adjacent upper and lower corner mounting members 276 and 278 attached to a vertical support leg 256 of the frame. Radial truss sections 280 extend between ends of the truss arm members 268-1 and 268-2 attached to a center support member 282 and ends of the truss arm members 268-1 and 268-2 attached the upper and lower intermediate mounting members 272 and 274 of each outer peripheral truss sections 264-1 and 264-2, respectively. In other embodiments, the frame assembly 252 and peripheral truss sections 264-1 and 264-2 may include other collapsible architectures, e.g. geodesic domes, grid shell structures, cathedral style structures, marquee structures, etc., as the same will be understood by those of skill in the art.

In FIG. 2, a collapsible shelter system 250 is illustrated. In a number of embodiments, a number of collapsible shelter anchors 220 can be coupled to the collapsible frame assembly 252. Each collapsible shelter anchor 220 can include a container 222 and each container 222 can include an opening reinforced about at least a portion of its periphery as described above (not visible in FIG. 2 as the container 222 is folded over, concealing the opening within the folds). The opening can be reinforced about at least a portion of its periphery with a reinforcing material 228. In a number of embodiments, opposing sides of the opening of each container 222 can be configured to be releasably engaged from one another via a buckle mechanism that includes a first releasably engageable body 232 and a second releasably engageable body 234. Each container 222 can include a first eyelet 236 and a second eyelet 238 coupled to a periphery of the opening of the container 222. The first eyelet 236 and the second eyelet 238 are attached, via a looped portion of reinforcing material 228, opposite one another about the opening of the container 222, but are depicted adjacent one another after having been brought together by the engagement of the first releasably engageable body 232 and the second releasably engageable body 234.

Each container 222 can include a sidewall 224. The sidewall 224 can comprise a rugged but flexible material. In a number of embodiment, the sidewall 224 can include a portion of the sidewall, proximal to the opening, configured to be folded over a number of times to create a sealed opening (as depicted in FIG. 2). For example the sidewall 224 can be comprised of a sufficiently flexible material that it can be folded over a number of times sufficient to collapse excess sidewall 224 down to the level of any contents of the container 222. For example, the sidewall 224 can be sufficiently flexible that a selectable amount of turns or folds of any suitable proportions can be introduced to collapse the sidewall 224 down toward a level at or near the variable level of contents within the container 222 while still permitting the first releasably engageable body 232 and the second releasably engageable body 234 to be engaged. In this configuration, the buckle mechanism can serve to, among other things, retain the fold over of the sidewall 224 of the container 222. Upon folding a sidewall 224 over a number of times to create a sealed opening the buckle mechanism (e.g., 232 and 234) of a container 222 can be releasably engaged.

Additionally, each container 222 can include a bottom wall (e.g., bottom wall 140 in FIG. 1, not visible in FIG. 2) attached to the sidewall 224. Each container 222 can have a central cavity (not visible in FIG. 2) comprising a volume of space within an area bounded by the sidewall 224 and the bottom wall. Each container 222 can be configured to be filled (e.g., via its opening) with an adjustable volume of material (not visible in FIG. 2) within the central cavity. In a number of embodiments, the central cavity of each container 222 can be configured to be filled with an adjustable volume of various material types, e.g., at least one of water, earth, sand, rocks and/or any other suitable material. Each anchor 220 can weigh less than half a pound (0.5 lbs.). The central cavity can be configured to be filled to create a range to the first adjustable weight level of the container 222. For example, a selectable amount of sand can be placed in the container 222 to provide a first adjustable weight level in a range from half a pound (0.5 lbs.) to fifty pounds (50 lbs.). In another example, a selectable volume of liquid, e.g., water, can be added to the container 222 to fill the container 222 from zero liters (0.0 L) to eight liters (8 L). Embodiments, however, are not limited to these examples.

FIG. 2 illustrates the collapsible shelter anchor system 250 including a baseplate 242. Each baseplate 242 can reinforce the bottom wall (not visible) of one container 222. For example, each baseplate 242 can rest on the ground and reinforce the bottom wall (not visible) from abrasion and/or wearing associated with contacting the ground.

The collapsible shelter anchor system 250 embodiment of FIG. 2 includes a sidewall extension portion 244. The sidewall extension portion 244 can include a first end coupled to the sidewall 224 of one container 222 and a second end coupled to one baseplate 242. The baseplate 242 and/or sidewall extension portion 244 can assist with the collapsible shelter anchor 250 system resting flat on a surface and standing upright.

Each baseplate 242 can include a vent 246 configured to provide ventilation to a cavity (not visible) between the baseplate 242 and the container 222 coupled via the sidewall extension portion 244. The cavity (not visible) can comprise a space within an area bounded by the sidewall extension portion 244 and between the container 222 and the baseplate 242 wherein the sidewall extension portion 244, container 222, and the baseplate 242 may contact one another but are not fixed to one another.

FIG. 2 includes a coupling mechanism. A coupling mechanism can couple an anchor 220, as described herein, to a collapsible frame assembly 252 and/or canopy 254 at a number of locations, e.g., points and/or attachment locations. In a number of embodiments, there can be a number of coupling mechanisms that can couple a number of anchors 220 to a collapsible frame assembly 252 and/or canopy 254. The coupling mechanism can couple at least one anchor 220 to a portion of a collapsible truss section (e.g., 264-1, 264-2, and 280) and/or an end of a truss section (e.g., 274, 278, 282) of the collapsible shelter. In a number of embodiments, the coupling mechanism can couple at least one anchor 220 to a collapsible truss section (e.g., 264-1, 264-2, and 280) at a scissor-like pivotal truss arm members 268-1 and 268-2. That is, in some embodiments the coupling mechanism can couple at least one anchor 220 to a collapsible truss section (e.g., 264-1, 264-2, and 280) at a portion of scissor-like pivotal truss arm member 268-1 and 268-2 proximal upper and lower corner mounting members 276 and 278 attached to vertical support legs 256 of the frame. In a number of embodiments, the coupling mechanism can additionally or alternatively couple at least one anchor 220 to a collapsible truss section (e.g., 264-1, 264-2, and 280) at a portion of scissor-like pivotal truss arm members 268-1 and 268-2 proximal a center support member 282 and/or at a mid-point 270 of a truss section (e.g., 264-1, 264-2, and 280).

The coupling mechanism can include a first end releasably coupled to at least one eyelet (e.g., 236 and 238) attached about the opening of the container 222 and a second end releasably coupled to a collapsible truss section (e.g., 264-1, 264-2, and 280) and/or canopy 254 of a collapsible shelter, as discussed above. In a number of embodiments, the second end can be releasably coupled to a dedicated attachment point (not shown) configured to accept the coupling apparatus of the second end. For example, the coupling mechanism can include a tensioning strap 284. In a number of embodiments, the tensioning strap 284 can have hooks 286-1 and 286-2 on its ends. However, coupling apparatus embodiments are not limited to hooks, 286-1 and 286-2, and can include hook and loop fasteners (e.g., Velcro), snaps, and/or other attachment means. A first hook 286-1 can be configured to couple to eyelets (e.g., 236 and 238) attached about the opening of the container 222. A second hook 286-2 can be configured to couple to a collapsible truss section (e.g., 264-1, 264-2, and 280) and/or canopy 254 of a collapsible shelter. In a number of embodiments the second hook 286-2 can be coupled proximal to a portion of a collapsible truss section (e.g., 264-1, 264-2) attached to a lower corner mounting members 278 that is attached to a vertical support leg 256. When coupled to the collapsible truss section (e.g., 264-1, 264-2, and/or 280) of a collapsible shelter and the eyelets (e.g., 236 and 238) of an anchor 220, the tensioning strap 284 can be adjusted such that the gravitational force upon the contents of the central cavity of the anchor 220 acts to anchor the collapsible shelter against other forces. For example, the tensioning strap 284 can be adjusted via drawing more of the tensioning strap 284 through an adjustable tensioning mechanism (e.g., tensioning strap buckle 285). A tensioning strap buckle 285 (e.g., tension lock buckle, cam buckle, etc.) can adjust the amount of the weight of the central cavity contents that acts on the collapsible frame assembly 252 and/or canopy 254 to achieve a second and/or third adjustable weight level as described above. Adjusting the tensioning strap 284 via a tensioning strap buckle 285 can allow the user to apply a selectable amount of force to the collapsible frame assembly 252 while avoiding the dangers associated with fully suspended ballasts that can, for example, sway in the wind. That is, while substantially the full weight of the anchor 220 and its contents can be applied to the collapsible frame assembly 252, the adjustability of the tensioning strap 284 via a tensioning strap buckle 285 allows the baseplate 242 to be positioned to remain in contact with a ground surface providing frictional resistance to swaying.

Figure 2A:
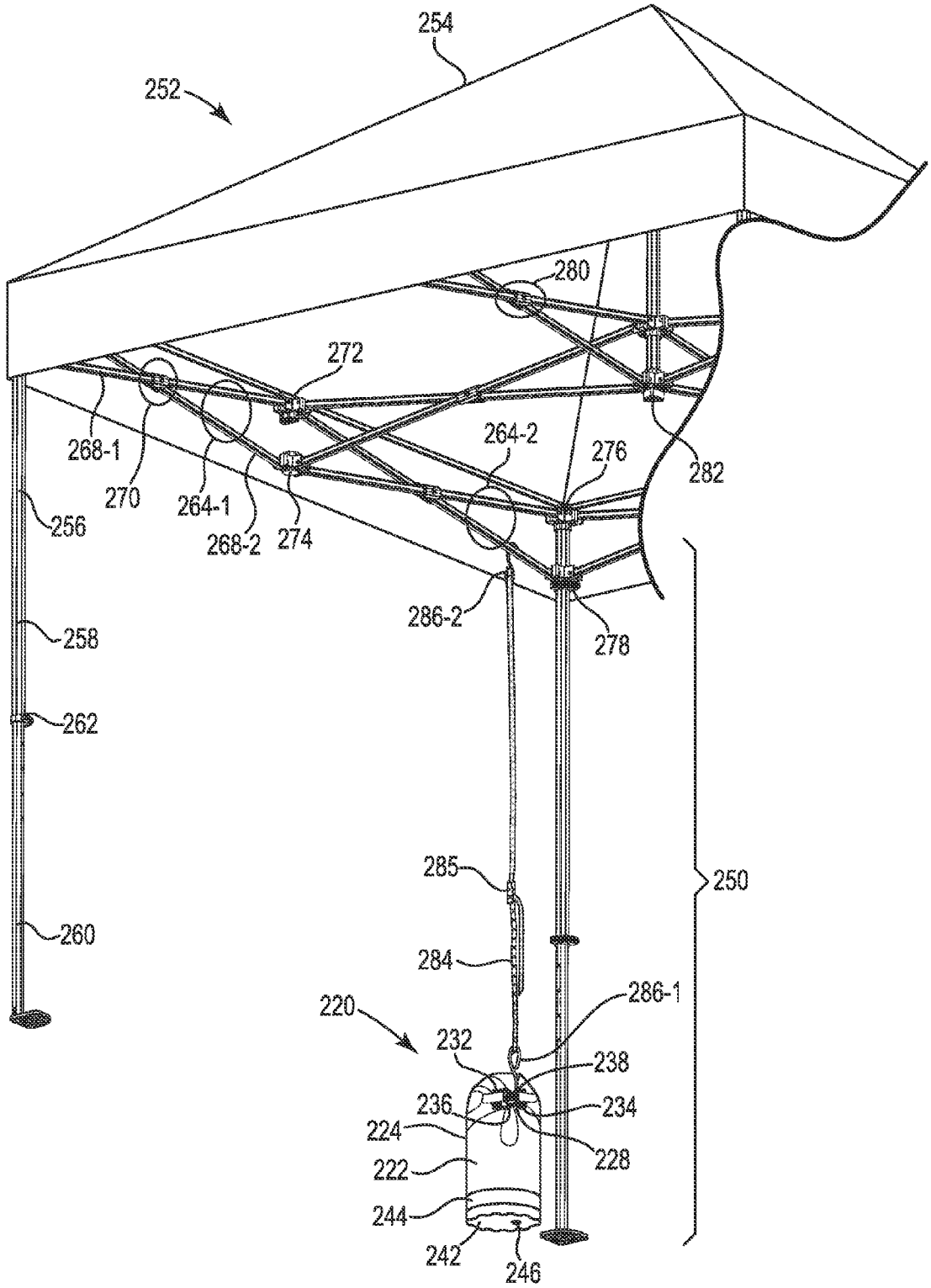
FIG. 2A is a perspective view of a collapsible shelter anchor system releasably coupled to a collapsible shelter.
Figure 2B:
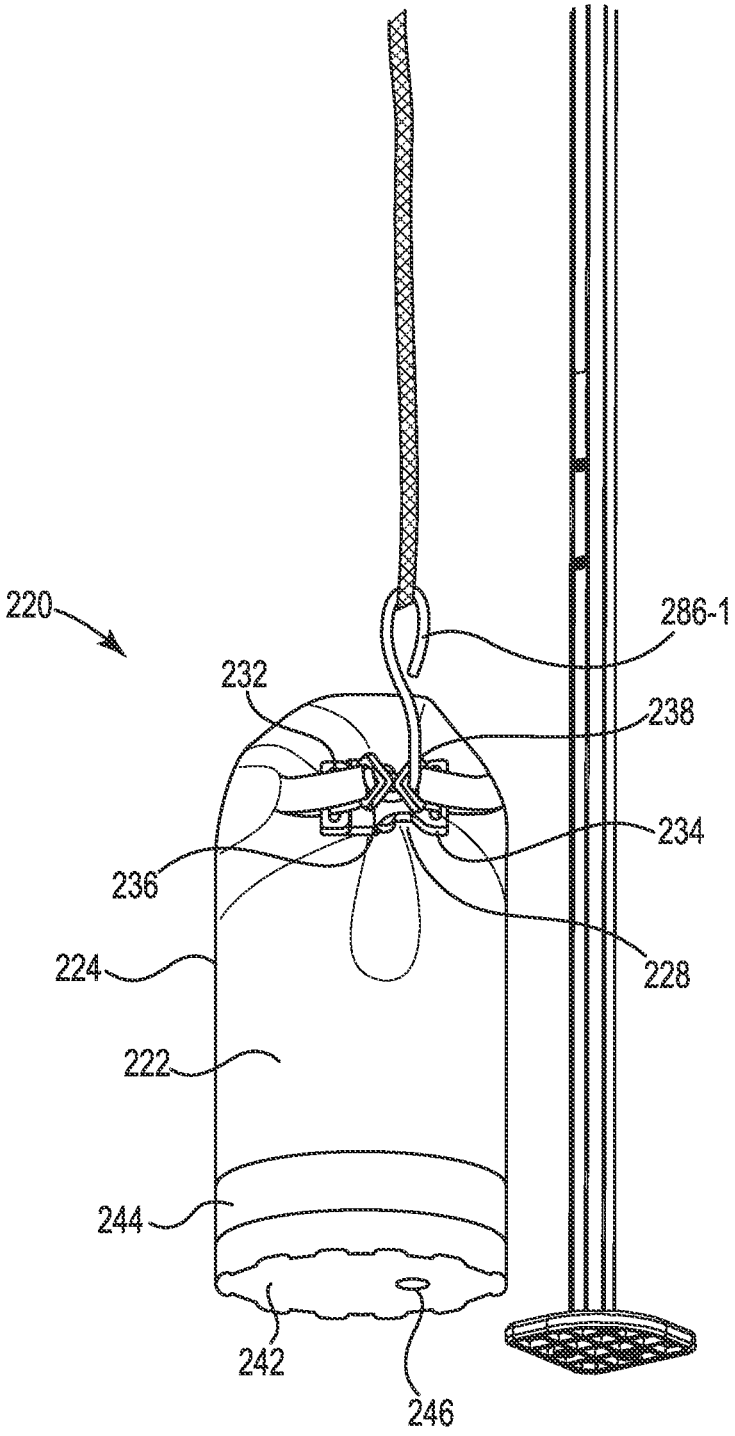
FIG. 2B is a perspective view of a portion of the collapsible shelter anchor system of FIG. 2A.

FIG. 2B is a perspective view of a portion of the collapsible shelter anchor system of FIG. 2A. FIG. 2B illustrates a magnified view offering greater detail of a coupling mechanism including a first end releasably coupled to eyelets 236 and 238 attached about the opening of the container 222. FIG. 2B illustrates the first end of a coupling mechanism as a first hook 286-1 simultaneous coupled to eyelet 236 and eyelet 238 to encourage the first releasably engageable body 232 and the second releasably engageable body 234 together when coupled to the eyelets 236 and 238. The simultaneous coupling of the first hook 286-1 to eyelets 236 and 238 can provide at least two points of tethering to the container 222 and can, in combination with the reinforcing material 228 and an engaged first releasably engageable body 232 and second releasably engageable body 234, form a force distributing component which distributes force associated with, tethering, lifting or suspending the container 222. In distributing force, the simultaneous coupling of the first hook 286-1 to eyelets 236 and 238 can retain the positioning of the baseplate 242 in contact with a ground surface providing frictional resistance to swaying and can prevent leakage of the contents of the container 222 resulting from an uneven tethering, lifting or suspending the container 222.

Figure 3:
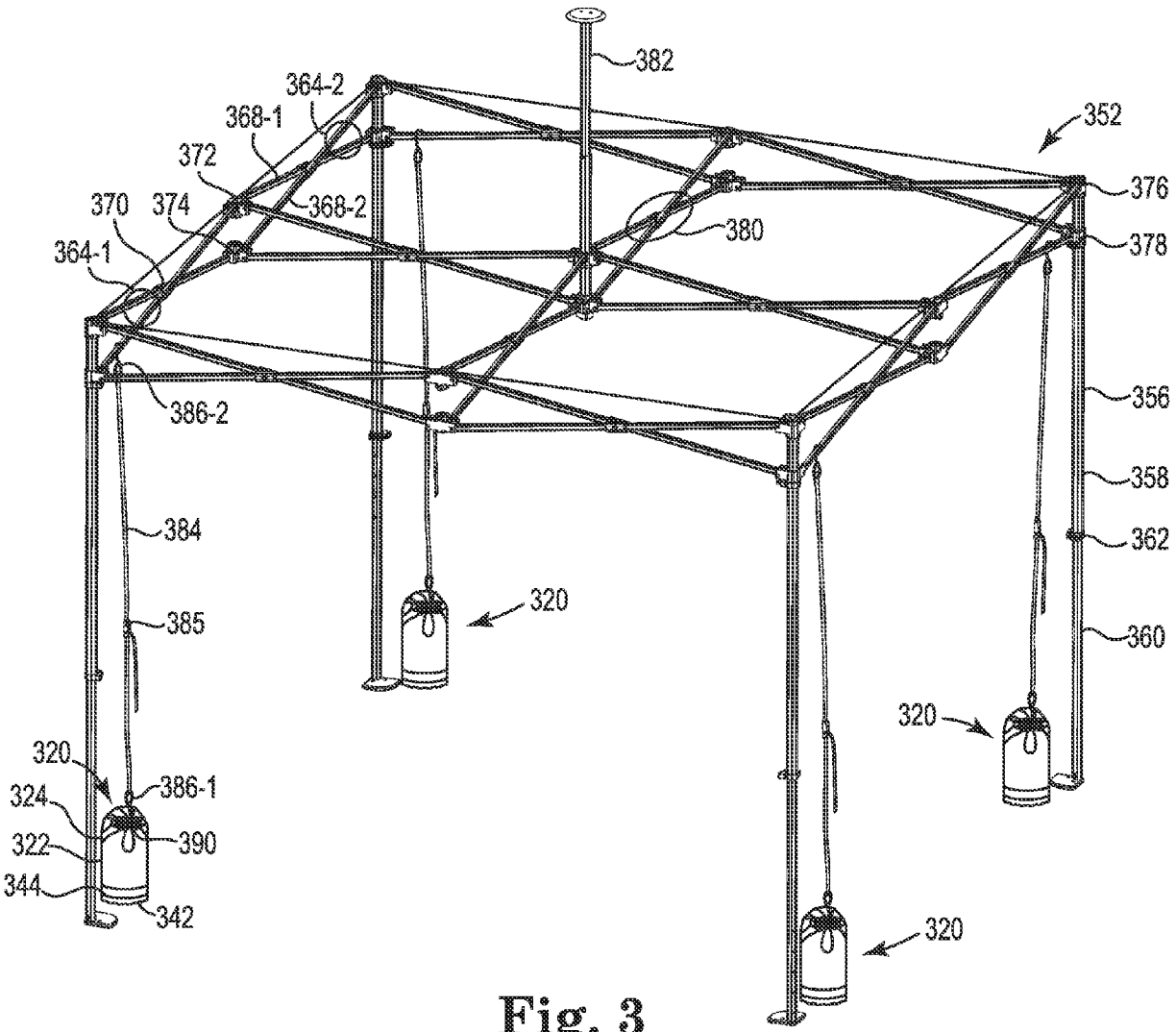
FIG. 3 is a perspective view of a collapsible shelter with anchors releasably coupled proximal to the vertical support legs of the collapsible shelter.

FIG. 3 is a perspective view of a collapsible shelter with anchors (e.g., 320) releasably coupled proximal to the vertical support legs of the collapsible frame assembly 352. The collapsible frame assembly 352 has four vertical support legs 356 at spaced peripheral intervals. In a number of embodiments, the collapsible frame can have any number of vertical support legs at spaced peripheral intervals. Each vertical support leg 356 can have an upper and lower telescoping members 358 and 360 which can be connected with an adjustable locking member 362 to regulate a length of extension. In a number of embodiments, the vertical support legs can be of any suitably shaped cross-section and can be comprised of any number of telescoping members. In some embodiments, the vertical support legs may also incorporate other mechanisms of extension and collapse (e.g. folding, detachable assembly, etc.). As depicted, the frame assembly 352 has outer peripheral truss sections 364-1 and 364-2 made up of two pair of scissors-like pivotal truss arm members 368-1 and 368-2, each pair interconnected at pivotal x-joints 370. The truss sections are connected in end-to-end relation to one another by upper and lower intermediate mounting members 372 and 374 between adjacent upper and lower corner mounting members 376 and 378 attached to vertical support legs 356 of the frame. Radial truss sections 380 extend between ends of the truss arm members 368-1 and 368-2 attached to a center support tube 382 and ends of the truss arm members 368-1 and 368-2 attached the upper and lower intermediate mounting members 372 and 374 of each outer peripheral truss section 364-1 and 364-2, respectively. In other embodiments, the frame assembly 352 and peripheral truss sections 364-1 and 364-2 may include other collapsible architectures, e.g. geodesic domes, grid shell structures, cathedral style structures, marquee structures, etc., as the same will be understood by those of skill in the art.

The collapsible shelter of FIG. 3 includes a number of anchors 320. Each of the anchors 320 includes a container 322. Each container 322 includes an opening (not visible in FIG. 3 because the openings are obscured by the closed conformation and folded over configuration) reinforced about at least a portion of its periphery, a sidewall 324 and a bottom wall (not visible in FIG. 3) attached to the sidewall 324.

Each of the number of anchors 320 is additionally depicted as including a base plate reinforcing the bottom wall 342 of the container 322. Each of the number of anchors 320 includes a sidewall extension portion 344 coupling each container 322 to each baseplate 342.

FIG. 3 includes a number of coupling mechanisms (e.g., 384, 385, 386-1, and 386-2). The number of coupling mechanisms can couple the number of containers 322 to the collapsible truss section (e.g., 364-1, 364-2, and 380). Specifically depicted in FIG. 3, the number of coupling mechanisms (e.g., 384, 385, 386-1, and 386-2) couple the number of containers 322 to scissors-like pivotal truss arm members 368-1 and/or 368-2 of the outer peripheral truss sections 364-1 and/or 364-2 of the collapsible frame assembly 352 at locations proximal the corner mounting members 376 and 378 attached to vertical support legs 356 of the frame. The collapsible shelter of FIG. 3 includes at least one anchor 320 coupled to a portion of the collapsible truss section (e.g., 364-1, 364-2, and/or 380) proximal each of the number of vertical support legs 356. However, the number of coupling mechanisms (e.g., 384, 385, 386-1, and 386-2), the number of anchors 320, and the location of the collapsible structure to which they couple is not limited to such an embodiment. The number of anchors 320 can be any number of anchors 320 coupled to any portion of the collapsible shelter and/or an associated canopy.

Each of the number of coupling mechanisms (e.g., 384, 385, 386-1, and 386-2) depicted in FIG. 3 are shown including a first end of a tensioning strap 386-2 that is releasably coupled to at least one eyelet 390 of an anchor 320 and a second end of a tensioning strap 386-1 that is releasably coupled to a portion of the collapsible truss section (e.g., 364-1, 362-2, and/or 380) proximal to one of the number of vertical support legs 356. In FIG. 3, the first end of a tensioning strap 386-1 and the second end of a tensioning strap 386-2 are depicted as coupling hooks, but could include any number of mechanisms suitable for engaging the collapsible shelter and/or the anchor 320. FIG. 3 illustrates an adjustable tensioning mechanism (e.g., tensioning strap buckle 385) positioned between the first end of a tensioning strap 386-2 and the second end of a tensioning strap 386-1. A tensioning strap buckle 385 (e.g., tension lock buckle, cam buckle, etc.) can adjust the amount of the weight of the central cavity contents to act on the collapsible frame assembly 352.

Although all embodiments have been described specifically in relation to use with a collapsible shelter, it is to be understood that the anchors described herein are readily adaptable for use with other types of frames.

It will be understood that when an element is referred to as being "on," "connected to" or "coupled with" another element, it can be directly on, connected, or coupled with the other element or intervening elements may be present. In contrast, when an element is referred to as being "directly on," "directly connected to" or "directly coupled with" another element, there are no intervening elements or layers present. As used herein, the term "and/or" includes any and all combinations of a number of the associated listed items.

Although specific embodiments have been illustrated and described herein, those of ordinary skill in the art will appreciate that an arrangement calculated to achieve the same results can be substituted for the specific embodiments shown. This disclosure is intended to cover adaptations or variations of a number of embodiments of the present disclosure. It is to be understood that the above description has been made in an illustrative fashion, and not a restrictive one. Combination of the above embodiments, and other embodiments not specifically described herein will be apparent to those of skill in the art upon reviewing the above description. The scope of the number of embodiments of the present disclosure includes other applications in which the above structures and methods are used. Therefore, the scope of a number of embodiments of the present disclosure should be determined with reference to the appended claims, along with the full range of equivalents to which such claims are entitled.

What is claimed is:

1. A collapsible shelter anchor, comprising:

a container, wherein the container includes an opening reinforced about at least a portion of its periphery, a sidewall having a bottom edge and a top edge, and a bottom wall attached to an inner face of the bottom edge of the sidewall;

a base plate reinforcing the bottom wall of the container, the base plate having a baseplate sidewall substantially perpendicular to the base plate, the baseplate sidewall having a top edge; and a sidewall extension portion having a top edge and a bottom edge, wherein an inner face of the top edge of the sidewall extension portion is directly coupled along the an outer face of the bottom edge of the sidewall of the container and an outer face of the bottom edge of the sidewall extension portion is directly fixedly coupled along an outer face of the top edge of the base plate sidewall forming a hollow cavity between the base plate and the bottom wall that is bounded by a circumference of the inner face of the sidewall extension portion and wherein the baseplate includes a vent configured to provide ventilation to the cavity.

2. The collapsible shelter anchor of claim 1, wherein the baseplate is made of a different, more rigid, material than a material from which the container is made.

3. The collapsible shelter anchor of claim 1, wherein the baseplate includes raised ridges arranged circumferentially about the baseplate that encourage the anchor to remain upright.

4. The collapsible shelter anchor of claim 1, wherein the opening of the container is reinforced about at least a portion of its periphery with a portion of material biasing the opening to a closed configuration.

5. A collapsible shelter anchor, comprising:

a container, wherein the container includes:

an opening reinforced about at least a portion of its periphery with a reinforcing material;

a releasable engagement mechanism having a first releasably engageable body and a second releasably engageable body coupled opposite one another about the opening of the container via the reinforcing material;

a first eyelet attached proximal the first releasably engageable body via passage of the reinforcing material through an opening in the body of the eyelet, wherein the first eyelet is made of a different, more rigid, material than the reinforcing material;

a second eyelet attached proximal the second releasably engageable body to the reinforcing material;

a sidewall having a bottom edge; and a bottom wall attached to the sidewall;

a base plate reinforcing the bottom wall, the baseplate having a top edge; and a sidewall extension portion having a top edge and a bottom edge, wherein the top edge of the sidewall extension portion is directly coupled along the bottom edge of the sidewall of the container and the bottom edge of the sidewall extension portion is directly coupled along the top edge of the base plate;

a coupling mechanism, wherein a first end of the coupling mechanism is releasably coupled to the container via the first eyelet and the second eyelet.

6. The collapsible shelter anchor of claim 5, wherein the first releasably engageable body and a second releasably engageable body are configured to bring the first eyelet and the second eyelet together to receive the coupling mechanism.

7. The collapsible shelter anchor of claim 6, wherein the coupling mechanism is configured to couple the container, at a second end, to a truss section of a collapsible shelter.

8. A collapsible shelter anchor system, comprising:

a collapsible shelter anchor including:

a container including an opening reinforced about at least a portion of its periphery, a sidewall having a bottom edge and a top edge, and a bottom wall attached to an inner face of the bottom edge of the sidewall;

a base plate reinforcing the bottom wall of the container, the baseplate having a base plate sidewall substantially perpendicular to the base plate, the baseplate sidewall having a top edge;

a sidewall extension portion having a top edge and a bottom edge, wherein an inner face of the top edge of the sidewall extension portion is directly coupled along an outer face of the bottom edge of the sidewall of the container and an outer face of the bottom edge of the sidewall extension portion is directly coupled along an outer face of the top edge of the base plate side wall forming a hollow cavity between the base plate and the bottom wall that is bounded by a circumference of the inner face of the sidewall extension portion; and a coupling mechanism, wherein the coupling mechanism couples the container to a collapsible truss section of a collapsible shelter.

9. The collapsible shelter system of claim 8, wherein the collapsible shelter anchor and the coupling mechanism allow an adjustable anchoring force to be applied to the collapsible truss section of the collapsible shelter according to at least three (3) different weight levels.

10. The collapsible shelter system of claim 9, wherein:

a first adjustable weight level includes an in-the-field of use, adjustable weight to the container by the addition and/or removal of an adjustable volume of material to the container;

a second adjustable weight level includes a weight of the container while supported resting on a surface with the coupling mechanism tethering the container to the collapsible truss section of the collapsible shelter; and a third adjustable weight level includes at least a portion of the first adjustable weight level of the container by the collapsible truss section of the collapsible shelter.

11. The collapsible shelter anchor system of claim 8, wherein the coupling mechanism is configured to couple to the collapsible truss section at three (3) different positions including an end of the collapsible truss section, a midpoint along a length of the collapsible truss section, and a center of an intersection of a number of collapsible truss sections.

12. The collapsible shelter anchor system of claim 8, wherein the container is waterproof and puncture resistant and is configured to receive an adjustable volume of material.

13. The collapsible shelter anchor system of claim 8, wherein the container includes a portion of the sidewall proximal to the opening having a reinforcing material that provides a crease line configured to be folded over a selectable number of times to create a sealed opening.

14. The collapsible shelter anchor system of claim 8, wherein opposing sides of the opening of the container are configured to be releasably engaged from one another via a buckle mechanism that includes a first releasably engageable body and a second releasably engageable body.

15. A collapsible shelter, comprising:

a collapsible shelter frame including a number of vertical support legs and a collapsible truss section interconnecting the number of vertical support legs;

an anchor including;

a collapsible container having an opening reinforced about at least a portion of its periphery, a sidewall having a bottom edge and a top edge, a bottom wall attached to an inner face of the bottom edge of the sidewall, a rigid base plate reinforcing the bottom wall of the container, the base plate having a baseplate sidewall substantially perpendicular to the base plate, the baseplate sidewall having a top edge; and a sidewall extension portion having a top edge and a bottom edge, wherein an inner face of the top edge of the sidewall extension portion is directly coupled along the an outer face of the bottom edge of the sidewall of the container and an outer face of the bottom edge of the sidewall extension portion is directly fixedly coupled along an outer face of the top edge of the base plate sidewall forming a hollow cavity between the base plate and the bottom wall that is bounded by a circumference of the inner face of the sidewall extension portion; and a coupling mechanism, wherein the coupling mechanism couples the collapsible container at the reinforced opening to the collapsible truss section of the collapsible shelter.

16. The collapsible shelter of claim 15, wherein the anchor comprises:

a first D-ring proximate a first releasably engageable body attached about the periphery of the opening of the collapsible container and a second D-ring proximate the second releasably engageable body attached opposite the first D-ring about the periphery of the opening of the collapsible container and making the first D-ring and the second D-ring adjacent one another when the first releasably engageable body and the second releasably engageable body are releasably engaged.

17. The collapsible shelter of claim 15, wherein the coupling mechanism comprises:

a first end releasably coupled to at least one eyelet attached about the opening of the collapsible container;

a second end releasably coupled to a canopy on the collapsible shelter frame of the collapsible shelter; and an adjustable tensioning mechanism between the first end and the second end.

18. The collapsible shelter of claim 15, wherein the coupling mechanism comprises:

a first end of a tensioning strap that is releasably coupled to an eyelet of the anchor; and a second end of the tensioning strap that is releasably coupled to a portion of the collapsible truss section proximal to a lower corner mounting member that is attached to one of the number of vertical support legs.

19. The collapsible shelter of claim 15, wherein the collapsible shelter comprises:

a canopy having a number of connection points affixed to the canopy; and wherein the coupling mechanism is configured to couple a number of anchors to at least one of the number of connection points, including a connection point proximal at least one of the number of vertical support legs.

* * * * *